United States Patent [19]

Scharf et al.

[11] 4,396,496

[45] Aug. 2, 1983

[54] CRACKING PROCESS

[75] Inventors: David R. Scharf; Earl H. Gray, both of Bartlesville, Okla.

[73] Assignee: Phillips Petroleum Company, Bartlesville, Okla.

[21] Appl. No.: 285,641

[22] Filed: Jul. 21, 1981

[51] Int. Cl.[3] ..... C10G 11/05; C10G 11/18

[52] U.S. Cl. ..... 208/120; 208/113; 208/114; 208/DIG. 1; 252/456; 252/457; 252/461

[58] Field of Search ..... 208/120, 113, 114, DIG. 1; 252/456, 457, 461

[56] References Cited

U.S. PATENT DOCUMENTS

| | | | |
|---|---|---|---|
| 3,030,300 | 4/1962 | Flanders et al. | 208/114 |
| 3,030,314 | 4/1962 | Knowlton et al. | 252/432 |
| 3,265,611 | 8/1966 | Flanders | 208/120 |
| 4,031,002 | 6/1977 | McKay | 208/113 |
| 4,036,740 | 7/1977 | Readal et al. | 208/120 |
| 4,148,714 | 4/1979 | Nielsen et al. | 208/114 |
| 4,153,534 | 5/1979 | Vasalos | 208/120 |
| 4,169,784 | 10/1979 | Nielsen et al. | 208/113 |

OTHER PUBLICATIONS

Shankland and Schmitkons "Determination of Activity and Selectivity of Cracking Catalyst" Proc. API 27 (III) 1947, pp. 57–77.

*Primary Examiner*—Delbert E. Gantz
*Assistant Examiner*—G. E. Schmitkons

[57] ABSTRACT

Antimony compounds are employed to reduce catalyst attrition and improve catalyst performance in catalytic cracking units, especially in conjunction with strontium compounds.

13 Claims, 1 Drawing Figure

CRACKING PROCESS

BACKGROUND OF THE INVENTION

Figure 1:
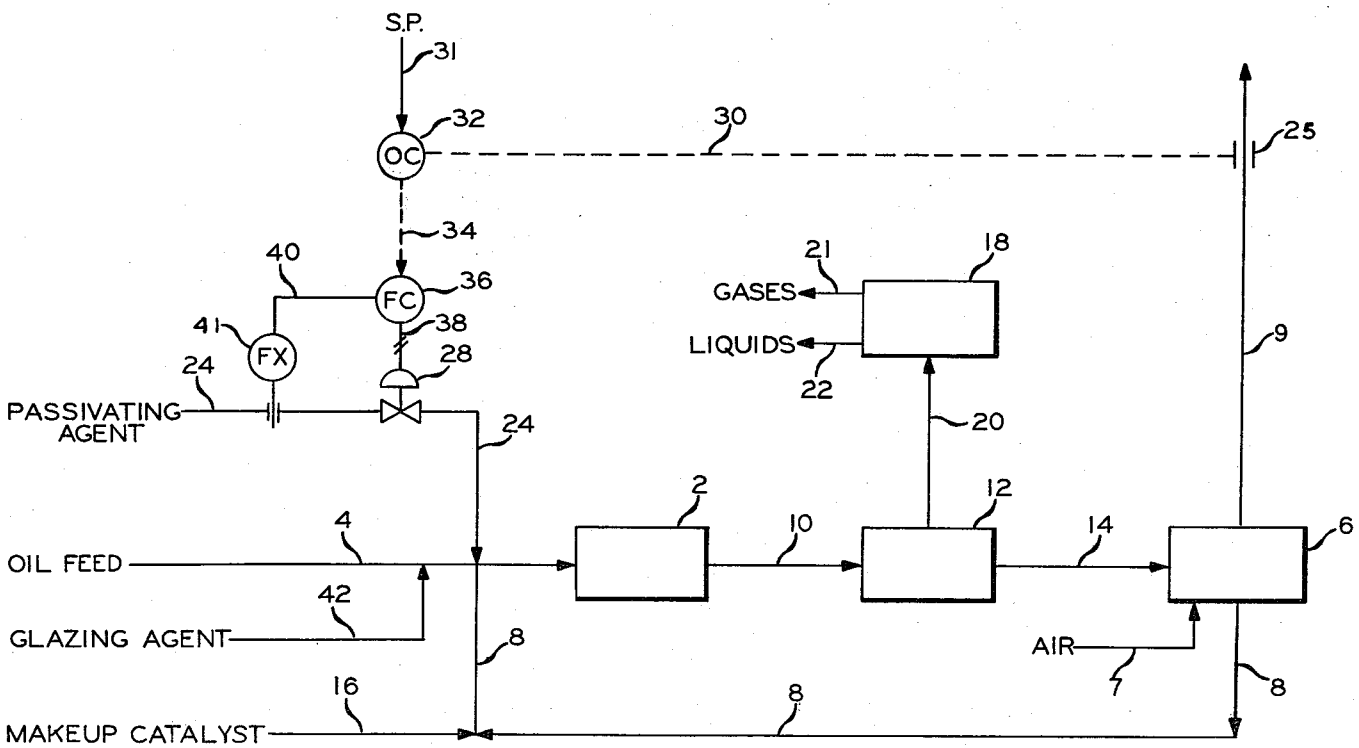

The present invention relates to an improved cracking catalyst, a process for forming the catalyst, and to a cracking process.

In the catalytic cracking of hydrocarbons, contaminants, such as nickel, vanadium, iron, and copper become deposited on the cracking catalyst from the feedstock impairing its ability to convert the feedstock to gasoline and enhancing its activity for converting the feedstock to coke and hydrogen, which are generally considered to be less desirable products than gasoline. It has been disclosed, by Cimbalo et al., "Oil & Gas Journal," Vol. 70, No. 20, May, 1972, pages 112, 114, 118, 120, and 122, for example, that the ratio between the molecular hydrogen and methane in the gaseous product from a catalytic cracking unit is representative of the intrinsic activity of the catalyst for converting the feedstock to coke and hydrogen and is relatively independent of commonly altered process variables such as conversion. Generally speaking, then, it is extremely desirable to provide cracking processes characterized by a low molecular hydrogen to methane ratio in the cracked product. The circulation of a passivating agent, such as antimony compounds in the catalytic cracking unit together with the catalyst lowers the hydrogen-to-methane mol ratio and yields greater gasoline production where contaminants are on the catalyst, for example.

In certain types of catalytic cracking units, especially those which employ a relatively large catalyst particle, for example, Thermofor (TCC) or Houdriflow units, in which the catalyst particles are beads commonly within the size range from about 500 to about 10,000 microns in size, catalyst attrition and erosion of the cracking unit by the catalyst are serious problems. A typical bead catalyst is a right cylinder of about 5 mm diameter by 5 mm length. The catalyst attrites to fines, which can escape the unit in the regenerator off-gases as a dust and perhaps cause environmental problems as well as an economic burden in replacing the amount of catalyst lost, which can range up to several thousands of dollars per day. It is known that stack opacity, that is, an inverse measurement of the clarity of the regnerator off-gases, is representative of the amount of catalyst fines being produced by and lost from the cracking unit. Generally speaking, then, it is desirable to provide cracking processes characterized by low stack opacity. It has been disclosed in U.S. Pat. No 3,030,300, for example, that the circulation of a glazing agent, such as strontium oxide, in a catalytic cracking unit together with the cracking catalyst will lower stack opacity and cause a reduction in unit erosion and catalyst losses from the unit, although barium sulfate is the glazing agent which has gained commercial acceptance.

OBJECTS OF THE INVENTION

It is an object of this invention to provide a cracking process characterized by a low molecular hydrogen to methane ratio in the cracked product effluent and a low stack opacity associated with the unit regenerator.

It is a further object of this invention to provide a modified cracking catalyst for use in the above process and also a method for its modification.

It is another object of this invention to provide a process for controlling stack opacity in a catalyst cracking unit.

SUMMARY OF THE INVENTION

In accordance with one aspect of the invention, it has been discovered that antimony compounds are usefully employed as glazing agents for treating cracking catalysts. In one application of this discovery, stack opacity from the catalyst regenerator of a cracking unit is monitored and the rate at which an antimony compound is added to the unit is adjusted so as to maintain stack opacity below a maximum desired value.

In accordance with another aspect of the invention, it has been discoverd that strontium compounds are usefully employed in combination with antimony compounds as passivating agents, and that antimony compounds are usefully employed in combination with strontium compounds as glazing agents. As a practical application of this discovery, it is much more desirable to utilize strontium compounds than barium compounds in Houdriflow or Thermofor type units, for example, which are on a metals passivation program utilizing an antimony compound, such as antimony O,O di-n-propylphosphorodithioate, for example.

When both of antimony and strontium together are circulated with the cracking catalyst, both the stack opacity and the $H_2/CH_4$ ratio are lower than when either antimony or barium is separately circulated through the unit. The decreased catalyst losses and increased yields of gasoline made possible by this invention can be worth thousands of dollars per day in a single catalytic cracking unit.

THE DRAWINGS

The FIGURE illustrates certain features of an embodiment of the invention by block diagram.

THE INVENTION

With reference to the FIGURE, a cracking catalyst is cycled in a cracking unit comprising a cracking zone 2, preferably a moving bed zone, and a regeneration zone 6, preferably a kiln. In the cracking zone, the catalyst contacts a hydrocarbon feed introduced into the zone via line 4. The zone 2 is maintained under cracking conditions to produce a mixture of coked cracking catalyst and a cracked product which includes molecular hydrogen and methane. The mixture 10 is separated in a zone 12 into a gaseous product stream 20 and a coked cracking catalyst stream 14. The product steam 20 is separated into a normally gaseous fraction 21 which includes molecular hydrogen and methane and a normally liquid fraction 22, which contains a gasoline fraction and higher boiling fractions, for example, in a separation zone 18, such as a fractionator. If desired, the gaseous stream 21 can be monitored by a gas chromatograph, for example, for characteristics which yield useful information about the cracking process, for example, to ascertain the hydrogen/methane mol ratio in the cracked product.

The coked cracking catalyst is conveyed from the zone 12 to the regeneration zone 6 via line 14. In the regeneration zone, which is maintained under regeneration conditions, the coked cracking catalyst is contacted with an oxygen-containing gas, such as air, which is introduced into the zone via the line 7 to produce a hot regenerated cracking catalyst of reduced coke content which is cycled back to the cracking zone via a line 8, for example, usually after being supplemented by fresh makeup catalyst added via line 16, and a gaseous effluent flue gas stream 9 which also contains a concentration of catalyst fines.

According to the invention, an antimony compound is added to the catalytic cracking unit for circulation with the catalyst inventory. Although most any antimony compound is suitable, antimony compounds selected from the group consisting of antimony oxide, antimony alkyl oxide, antimony aryl oxide, antimony sulfate, antimony sulfide and antimony hydro carbyl thiophosphates, is particularly preferred. Antimony O,O-di-n-propylphosphorodithioate is preferred because it has been tested with good results and is oil soluble. One convenient, and, in fact preferred, method of adding the antimony compound to the unit is in combination with the hydrocarbon feed, such as via conduit 26, which establishes a flow path between a passivating agent reservoir and the hydrocarbon feed line 4. Preferably, a valve 28 is associated with the conduit 24, so that the flow rate of the antimony compound can be adjusted, generally, so that the concentration of antimony, on an elemental basis, in the hydrocarbon feed stream 4, ranges from about 1 to about 1000 parts per million (ppm) based on total weight of the hydrocarbon charge entering zone 2, usually between about 5 and 50 ppm after start-up where the antimony compound is added on a continuous basis, which is preferred.

In accordance with a first embodiment of the invention, the addition rate of antimony compound is adjusted so as to maintain the concentration of catalyst fines in the regenerator off gases or flue gases below a predetermined level. Preferably, a means 25 for establishing a signal representative of the concentration of catalyst fines in the gaseous effluent stream 9 is associated with the off-gas stream. Preferably, the means 25 measures stack gas opacity and establishes a signal 30 representative of stack gas opacity. The signal 30 is received by a means 32 for establishing a signal 34 representative of a predetermined relationship between the signal 30 and a set point signal 31. The set point signal 31 must be experimentally determined for each unit and is preferably representative of a desired maximum value for the signal 30, the predetermined relationship between the signals 30 and 31 is preferably a comparison, such as a difference, and the means 32 preferably comprises an opacity controller. Preferably, the signal 34 is scaled so as to be representative of a required flow rate of passivating agent to maintain the signal 30 below the set point signal 31. The signal 34 is received by a means 36 for establishing a signal 38 representative of a predetermined relationship between the signal 34 and a signal 40 representative of a measured flow rate of a passivating agent, established by a flow element 41, for example, associated with the line 24. The signal 38 is received by the valve 28, which is a motor valve in this embodiment, which is manipulated in response to the signal 38 to adjust the addition rate of passivating agent to the unit. Preferably, the means 36 comprises a flow controller, and the signal 38 is established in response to a comparison, such as the difference between the signals 34 and 40.

In accordance with a second embodiment of the invention both of an antimony compound and a strontium compund are circulated together with the cracking catalyst in the catalytic cracking unit. Generally, a sufficient amount of antimony compound is added to the catalyst so as to impart to the catalyst inventory a concentration of antimony of from about 0.005 to about 0.5 weight percent, based on the elemental weight of antimony added and the total weight of the catalyst inventory, including added antimony and strontium. The antimony compound can be of the types previously described and can be added to the unit via the line 24, for example. The strontium-containing glazing agent is added to the unit in an amount sufficient to impart to the catalyst inventory concentration of from about 0.01 to about 1 weight percent, preferably from about 0.1 to about 1 weight percent, based on the elemental weight of strontium and the total weight of the catalyst inventory, including added antimony and strontium.

Although most any strontium compound is suitable for use in this embodiment of the invention, it is preferred that halogen-containing strontium compounds be avoided because of their corrosive effect on process equipment. Preferred strontium compounds are selected from the group consisting of strontium oxide, strontium alkyl oxide, strontium aryl oxide and strontium sulfate, and are preferably introduced into the unit either as a suspension or solution in hydrocarbon diluent, such as a cycle oil. Strontium sulfate is the preferred glazing agent utilized in accordance with this aspect of the invention, because it has been employed with good results. It is preferably introduced into the unit in combination with the hydrocarbon feed 4, such as through line 42, for example. The hydrocarbon feed is preferably at a temperature of from 50° C. to about 160° C. prior to admixture with the passivation and glazing agents.

Generally, most any cracking catalyst can be utilized in the process of the invention. Silica-alumina cracking catalyst are preferred, especially those modified with zeolitic materials, because of their high activity and selectivity. The process of the invention is especially advantageous when utilized with so called "moving bed" catalytic cracking units, which employ a downwardly moving, non-fluidized bed of particles in the cracking zone. Generally, a major portion of the catalyst particles in these types of units have a particle size within the range of from about 500 microns to about 10,000 microns (10 mm), usually about 3000 to 6000 microns, typically a circular cross-section cylinder about 5 mm diameter by 5 mm in length. During operation of the unit, the particles attrite to form fines which are blown out of the unit, frequently in the flue gases from the catalyst regenerator, and from the separator surge vessel (not shown). Usually, the catalyst fines have a particle size below about 100 microns.

Generally, the hydrocarbon feedstock 4 will have an initial boiling point of above about 450° F., that is, above the gasoline boiling range, although material having a lower initial boiling point can be utilized if desired. Virgin gas oil is typically a preferred feed, and can be used in blend with a topped crude or residua which would otherwise be utilized for asphalt or the like. Topped crude or residua usually contain a relatively high concentration of metals, such as nickel, vanadium, iron and copper which become deposited on the cracking catalyst and cause its deterioration. Utilization of the invention can mitigate catalyst deterioration caused by metals deposition on the catalyst. It is preferred, however, that the hydrocarbon feed contain less than about 10 parts per million of catalytically active combined nickel, vanadium, iron, and copper, not including "tramp" iron, which originates between the oil field and the cracking unit, such as from corrosion, for example and can be considered catalytically inactive, because such feedstocks are easily economically processed by utilizing the process of the invention in a moving bed unit.

A commercial test of the invention was conducted in a TCC unit utilizing 500 tons of a zeolite modified silica alumina bead catalyst and charging 21,000 barrels/day of gas oil. On day 1, addition of Micro-Barites, which is about 1.3 weight percent barium and 45.7 weight percent strontium primarily as strontium sulfate, to the unit was terminated. The $H_2/CH_4$ ratio was about 1.63, and flue gas opacity was about 25%. A catalyst sample lost 10 wt% in a standard abrasion test. After day 2, the stack opacity had risen to about 40%. A catalyst sample lost 10.3 wt% in the standard abrasion test. Injection of Vanlube 622, which is about 12 weight percent antimony as antimony O,O-dipropylphosphorodithioate 80 weight percent in mineral oil, was started at a rate of about 4 gal/hour. The $H_2/CH_4$ ratio and the stack opacity each decreased. The injection rate was reduced on day 7 to about 0.4 gal/hour. A catalyst sample lost 9.1 wt% in the standard abrasion test. The $H_2/CH_4$ ratio increased slightly over several hours and stabilized. Flue gas opacity began increasing. One day 13, Micro-Barites was again introduced into the unit at an average rate of about 10 pounds/hour. Both the $H_2/CH_4$ ratio and flue gas opacity fell to their lowest levels observed during the test. A catalyst sample lost 8.9 wt% in the standard abrasion test. The $H_2/CH_4$ ratio fell from about 1.45 to about 1.30. On day 32, injection of Vanlube 622 was terminated. The $H_2/CH_4$ ratio and flue gas opacity slowly increased over a period of several days.

During a previous test in which Barytes, which is primarily barium sulfate, was circulated in the unit together with antimony, no significant change was noted in either flue gas opacity or in the $H_2/CH_4$ ratio. It should be noted, however, that the unit was not experiencing a severe problem with metals on the cracking catalyst in either test, analysis showing about 500 ppm Ni and about 1200 ppm V on the catalyst.

During tests on another TCC unit, this one not utilizing either a barium or strontium-containing glazing agent, the addition of antimony to the unit appeared to decrease flue gas opacity.

The following comparative example is provided to illustrate the probable effects of combined antimony and barium treatment of a cracking catalyst.

EXAMPLE

A commercial cracking catalyst that had been used in a commercial fluid catalytic cracker until it had attained equilbrium composition with respect to metals accumulation (catalyst was being removed from the process system at a constant rate), hereinafter CATALYST A, was used to demonstrate passivation with barium. The catalyst, being a synthetic zeolite combined with amorphous silica/alumina (clay), was predominantly silica and alumina. Concentrations of other elements together with pertinent physical properties are shown below:

| | |
|---|---|
| Surface area, $m^2 g^{-1}$ | 74.3 |
| Pore volume, ml $g^{-1}$ | 0.29 |
| Particle size, microns, | About 30 to about 80 |
| Composition, wt. % | |
| Nickel | 0.38 |
| Vanadium | 0.60 |
| Iron | 0.90 |
| Cerium | 0.40 |
| Sodium | 0.39 |
| Carbon | 0.06 |

A portion of this used, metals-contaminated catalyst was treated with barium as follows to form a catalyst referred to hereinafter as CATALYST B. A solution, prepared by dissolving 0.700 g of barium acetylacetonate in 35 ml of water, was stirred into 35 g of the used catalyst. Solvent was removed by heating, with stirring, on a hot plate at about 260° C. This treatment added 0.82 wt % barium to the catalyst. The treated catalyst was then prepared for testing by aging it. The catalyst, in a quartz reactor, was fluidized with nitrogen while being heated to 482° C., then it was fluidized with hydrogen while the temperature was raised from 482° to 649° C. Maintaining that temperature, fluidization continued for 5 minutes with nitrogen, then for 15 minutes with air. The catalyst was then cooled to about 482° C., still being fluidized with air. The catalyst was then aged through 10 cycles, each cycle being conducted in the following manner. The catalyst at about 481° C. was fluidized with nitrogen for one minute, then heated to 510° C. during two minutes while fluidized with hydrogen, then maintained at 510° C. for one minute while fluidized with nitrogen, then heated to about 649° C. for 10 minutes while fluidized with air, and then cooled to about 482° C. during 0.5 minutes while fluidized with air. After 10 such cycles it was cooled to room temperature while being fluidized with nitrogen.

The used catalyst and the barium-treated catalyst were evaluated in a fluidized bed reactor using topped West Texas crude oil as feedstock to the cracking step. The cracking reaction was carried out at 510° C. and atmospheric pressure for 0.5 minutes, and the regeneration step was conducted at about 649° C. and atmospheric pressure for about 30 minutes using fluidizing air, the reactor being purged with nitrogen before and after each cracking step.

Properties of the topped West Texas crude used in the cracking steps are summarized below:

| | | |
|---|---|---|
| API gravity at 15.6° C. | | 21.4° |
| Distillation (by ASTM D 1160-61) | | |
| IBP | 291° C. | |
| 10% | 428 | |
| 20% | 468 | |
| 30% | 498 | |
| 40% | 528 | |
| 50% | 555 | |
| Carbon residue, Ramsbottom | | 5.5 wt. % |
| Analysis for some elements | | |
| Sulfur | 1.2 wt. % | |
| Vanadium | 5.29 ppm | |
| Iron | 29 ppm | |
| Nickel | 5.24 ppm | |
| Pour point (by ASTM D 97-66) | | 17° C. |
| Kinematic viscosity (by ASTM D 455-65) | | |
| at 82.2° C. | 56.5 centistokes | |
| at 98.9° C. | 32.1 centistokes | |

Results of the tests using the two catalysts are summarized below:

| CATALYST USED | Catalyst to oil wt. ratio | Conversion, Vol. % | YIELDS Coke, Wt % of Feed | SCF $H_2$/BBL of Feed | Gasoline, Vol. % of Feed |
|---|---|---|---|---|---|
| A (no additive) | 7.7 | 74.9 | 17.6 | 895 | 54.6 |
| B (0.82 wt. % Barium) | 7.5 | 76.9 | 15.7 | 682 | 62.1 |

The Barium treatment improved the cracking characteristics of the metals-contaminated FCC catalyst.

The commercial fluid catalytic cracking catalyst A, above, was treated to contain 0.5 weight percent antimony, added as Phil-Ad-CA additive to the topped crude, with the topped crude being cracked with this catalyst. Phil-Ad-CA additive is available from Phillips Petroleum Company, Bartlesville, Okla. The active ingredient in Phil-Ad-CA additive is antimony O,O di-n-propylphosphorodithioate. This equilibrium catalyst, hereinafter CATALYST C gave the following results when tested using essentially the same procedure as before.

| CATALYST USED | Catalyst to oil wt. ratio | Conversion Vol. % | YIELDS Coke, Wt % of Feed | SCF $H_2$/BBL of Feed | Gasoline, Vol. % of Feed |
|---|---|---|---|---|---|
| C (0.5 Sb) | 7.2 | 75.8 | 12.1 | 330 | 62.8 |

The antimony treatment improved the cracking characteristics of the metal-contaminated FCC catalyst.

A commercial cracking catalyst that had been used in a commercial fluid catalytic cracker until it had attained equilibrium composition with respect of metals accumulation while cracking topped crude oil containing the antimony metals passivation agent Phil-Ad-CA resulted in a catalyst having an antimony content by weight of catalyst of 0.086. This catalyst, hereinafter CATALYST D had the following properties and was a synthetic zeolite combined with amorphous silica/alumina (clay), predominantly silica and alumina:

| | |
|---|---|
| Surface area, $m^2 g^{-1}$ | 80 |
| Pore volume, ml $g^{-1}$ | .37 |
| Particle size, microns: | about 30 to about 80 |
| Composition, wt. % | |
| Nickel | .28 |
| Vanadium | .53 |
| Iron | .70 |
| Cerium | .32 |
| Sodium | .66 |
| Carbon | 0.00 |
| Antimony | .086 |

Barium sulfate was dry mixed with catalyst D, above, to form a cracking catalyst, hereinafter CATALYST E containing 0.29 weight percent barium based on the total catalyst weight.

Results of the tests essentially as described before using the two catalysts are summarized below:

| CATALYST USED | Catalyst to oil wt. ratio | Conversion, Vol. % | YIELDS Coke, Wt % of Feed | SCF $H_2$/BBL of Feed | Gasoline, Vol. % of Feed |
|---|---|---|---|---|---|
| D (0.086 Sb) | 7.4 | 84.0 | 14.2 | 313 | 60 |
| E (0.086 Sb) (0.29 Ba) | 7.4 | 87.5 | 14.7 | 362 | 58.9 |

It does not appear that the combination of $BaSO_4$ (0.29 wt %) with an FCC catalyst containing 0.086 wt % Sb significantly affected catalyst activity. Based on this, it is surprising that combined strontium and antimony treatment of cracking catalyst yielded such beneficial results.

What is claimed is:

1. In a process comprising
(a) cycling a cracking catalyst in a catalytic cracking unit comprising a cracking zone and a regeneration zone, said cracking catalyst having a particle size principally within the range of from about 500 to about 10,000 microns; and
(b) contacting the cracking catalyst with a hydrocarbon feed in the cracking zone to produce a cracked product and a coked cracking catalyst and with an oxygen-containing gas in the regeneration zone to produce a regenerated cracking catalyst which is cycled back to the cracking zone and a gaseous effluent stream also containing a concentration of catalyst fines having a particle size principally below about 100 microns;
the improvement comprising
(c) adding an antimony compound to the catalytic cracking unit; and
(d) adjusting the addition of said antimony compound so as to maintain the concentration of catalyst fines below a predetermined value.

2. A process as in claim 1 further comprising
(a) establishing a first signal representative of the concentration of catalyst fines in the gaseous effluent stream from the regeneration zone; and
(b) adjusting the addition of antimony compound in response to said first signal.

3. A process as in claim 2 further comprising
(a) establishing a second signal representative of a desired maximum concentration of catalyst fines in the gaseous effluent stream from the regeneration zone;
(b) comparing the first signal to the second signal and establishing a third signal in response to said comparison; and
(c) adjusting the addition rate of the antimony compound in response to the third signal.

4. A process as in claim 3 wherein from about 0.005 to about 0.5 weight percent antimony, based on weight elemental antimony to total weight of cracking catalyst is maintained on the cracking catalyst, and wherein the antimony compound is selected from the group consisting of antimony oxide, antimony alkyl oxide, antimony aryl oxide, antimony sulfate, antimony sulfide, and antimony hydrocarbyl thiophosphate.

5. A process as in claim 4 wherein the antimony compound comprises antimony di-n-propylphosphorodithioate which is added to the cracking unit in combination with the hydrocarbon feed.

6. A process comprising (a) circulating an inventory of cracking catalyst in a catalytic cracking unit comprising a cracking zone and a regeneration zone:

(b) contacting the cracking catalyst with a hydrocarbon feedstock in the cracking zone to produce a coked cracking catalyst and a cracked product which contains methane and molecular hydrogen and with an oxygen-containing gas in the regeneration zone to produce a regenerated cracking catalyst which is introduced back to the cracking zone and a gaseous effluent stream also containing a concentration of catalyst fines at least a portion of which have a particle size below about 100 microns;

(c) circulating together with the cracking catalyst a strontium compound in an amount of from about 0.01 to about 1 weight percent, based on the elemental weight of strontium and the total weight of the catalyst inventory, including the strontium compound; and (d) circulating together with the cracking catalyst an antimony compound in an amount of from about 0.005 to about 0.5 weight percent, based on the elemental weight of antimony and the total weight of the catalyst inventory, including antimony.

7. A process as in claim 6 wherein from about 0.1 to about 1 weight percent of strontium and from about 0.01 to about 0.5 weight percent of antimony are circulated together with the catalyst inventory, and a major portion of said cracking catalyst was a particle size within the range of from about 500 to about 10,000 microns.

8. A process as in claim 6 wherein the catalyst inventory comprises zeolite-modified silica-alumina cracking catalyst, a major portion of which has a particle size within the range of from about 3000 to about 6000 microns.

9. A process as in claim 7 wherein a sufficient amount of strontium is circulated with the catalyst inventory to lower the ratio between the molecular hydrogen and methane in the cracked product from the cracking zone and wherein a sufficient amount of antimony is circulated with the catalyst inventory to lower the concentration of catalyst fines in the effluent stream from the regeneration zone.

10. A process as in claim 8 further comprising introducing into the cracking unit a strontium compound selected from the group consisting of strontium oxide, strontium alkyl oxide, strontium aryl oxide and strontium sulfate and an antimony compound selected from the group consisting of antimony oxide, antimony alkyl oxide, antimony aryl oxide, antimony sulfate, antimony sulfide and antimony hydrocarbyl thiophosphate.

11. A process as in claim 8 wherein the strontium compound comprises strontium sulfate and the antimony compound comprises antimony O,O-di-n-propylphosphorodithioate.

12. A process as in claim 11 wherein the strontium compound and the antimony compound are introduced into the cracking unit in combination with the hydrocarbon feedstock which is at a temperature of between about 50° C. and about 160° C., and wherein the hydrocarbon feedstock contains less than 10 parts per million of combined nickel, vanadium, copper, and iron, not including "tramp" iron, on an elemental basis based on total weight of feedstock.

13. A cracking catalyst composition formed in accordance with a process as set forth in claim 6.

* * * * *